US011765804B2

(12) United States Patent
Kim et al.

(10) Patent No.: US 11,765,804 B2
(45) Date of Patent: Sep. 19, 2023

(54) PROGRAMMABLE LIGHT SOURCE OUTPUT CONTROL DEVICE USING ELECTRONIC FUSE, LIGHTING DEVICE, AND METHOD OF PROGRAMMING LIGHTING DEVICE

(71) Applicant: 3ALogics Inc., Gyeonggi-do (KR)

(72) Inventors: Sung Wan Kim, Gyeonggi-do (KR); Pyeong Han Lee, Gyeonggi-do (KR); Kwang Beom Park, Gyeonggi-do (KR); Sung Hun Chun, Gyeonggi-do (KR); Chang Ho Ryu, Gyeonggi-do (KR)

(73) Assignee: 3ALogics Inc., Gyeonggi-do (KR)

( * ) Notice: Subject to any disclaimer, the term of this patent is extended or adjusted under 35 U.S.C. 154(b) by 0 days.

(21) Appl. No.: 17/748,129

(22) Filed: May 19, 2022

(65) Prior Publication Data

US 2023/0070537 A1 Mar. 9, 2023

(30) Foreign Application Priority Data

Sep. 9, 2021 (KR) ..... 10-2021-0120060

(51) Int. Cl.
*H05B 45/50* (2022.01)

(52) U.S. Cl.
CPC ..... *H05B 45/50* (2020.01)

(58) Field of Classification Search
None
See application file for complete search history.

(56) References Cited

U.S. PATENT DOCUMENTS

| | | | | |
|---|---|---|---|---|
| 9,854,651 | B2 | 12/2017 | Lai et al. | |
| 10,149,358 | B1 * | 12/2018 | Tischler | H05B 45/10 |
| 2013/0334980 | A1 * | 12/2013 | Zhou | H05B 47/185 315/250 |

FOREIGN PATENT DOCUMENTS

| | | |
|---|---|---|
| KR | 10-1896686 | 9/2018 |

* cited by examiner

*Primary Examiner* — Anh Q Tran

(57) ABSTRACT

Provided is a programmable light source output control device. A light source output control device includes electronic fuses, a power stage configured to receive external power, generate actuating power according to the external power and a state of each of the electronic fuses, and supply the actuating power to a light source, and a setting circuit configured to set the state of each of the electronic fuses.

12 Claims, 6 Drawing Sheets

PROGRAMMABLE LIGHT SOURCE OUTPUT CONTROL DEVICE USING ELECTRONIC FUSE, LIGHTING DEVICE, AND METHOD OF PROGRAMMING LIGHTING DEVICE

RELATED APPLICATION

This application claims the benefit of priority of Korea Patent Application No. 10-2021-0120060 filed on Sep. 9, 2021, the contents of which are incorporated by reference as if fully set forth herein in their entirety.

FIELD AND BACKGROUND OF THE INVENTION

One or more example embodiments relate to a programmable light source output control device, and more particularly, to a programmable light source output control device using an inductive coupling device and an electronic fuse, a lighting device, and a method of programming the lighting device.

DESCRIPTION OF THE RELATED ART

The quality of a light emitting diode (LED) driver, which is a key component of an LED lighting device, affects safety and stability of the LED lighting device.

A desired output current of the LED driver should be set according to the number of LEDs. Examples of methods of setting the output current of the LED driver that drive the LEDs include a method of setting the output current by putting a resistor in terminals of the LED driver, a method of setting the output current using dip switches installed in the LED driver, a method of setting the output current using software of a personal computer (PC) connected to the LED driver, and a method of setting the output current using near field communication (NFC).

PRIOR ART DOCUMENT

[Patent Document]

(Patent Document 1) U.S. Pat. No. 9,854,651 (Issued on Dec. 26, 2017)

(Patent Document 2) Korean Patent No. 10-1896686 (Issued on Sep. 10, 2018)

SUMMARY OF THE INVENTION

Example embodiments provide a programmable light source output control device which detects at least one of a level and frequency of output power output from an output circuit of an inductive coupling device, programs electronic fuses using a detection signal corresponding to a result of the detection, and generates actuating power to be supplied to a light source according to output signals of the programmed electronic fuses, a lighting device, and a method of programming the lighting device.

According to an aspect, there is provided a programmable light source output control device including electronic fuses, a power stage configured to receive external power, generate actuating power according to the external power and a state of each of the electronic fuses, and supply the actuating power to a light source, and a setting circuit configured to set the state of each of the electronic fuses.

The light source output control device may further include an inductive coupling device configured to transmit power using inductive coupling, and the setting circuit may include a power level detector configured to detect a level of output power of the inductive coupling device and output a power level detection signal according to a result of the detection, and a fuse setting circuit configured to set the state of each of the electronic fuses by using the power level detection signal.

The light source output control device may further include an inductive coupling device configured to transmit a frequency using inductive coupling, the setting circuit may include a frequency detector configured to detect a frequency of output power of the inductive coupling device and output a frequency detection signal according to a result of the detection, and a fuse setting circuit configured to set the state of each of the electronic fuses by using the frequency detection signal.

According to another aspect, there is provided a lighting device including a light source, electronic fuses, a power stage configured to receive external power, generate actuating power according to the external power and a state of each of the electronic fuses, and supply the actuating power to the light source, and a setting circuit configured to set the state of each of the electronic fuses.

According to another aspect, there is provided a method of programming a lighting device including a light source including setting, by using an inductive coupling device, at least one of a level and a frequency of output power of the inductive coupling device, detecting at least one of the level and the frequency using a setting circuit, programming electronic fuses using a result of the detection using the setting circuit, and generating power to be supplied to the light source according to states of the electronic fuses programmed using a power stage. The method of programming the lighting device may further include supplying set power to the light source, using the power stage.

Additional aspects of example embodiments will be set forth in part in the description which follows and, in part, will be apparent from the description, or may be learned by practice of the disclosure.

According to example embodiments, a programmable light source output control device, a lighting device, and a method of programming the lighting device have effects of detecting at least one of a level and frequency of output power output from an output circuit of an inductive coupling device, programming electronic fuses using a detection signal corresponding to a result of the detection, and generating actuating power to be supplied to a light source according to output signals of the programmed electronic fuses.

BRIEF DESCRIPTION OF THE SEVERAL VIEWS OF THE DRAWINGS

These and/or other aspects, features, and advantages of the invention will become apparent and more readily appreciated from the following description of example embodiments, taken in conjunction with the accompanying drawings of which.

DESCRIPTION OF SPECIFIC EMBODIMENTS OF THE INVENTION

Figure 1:
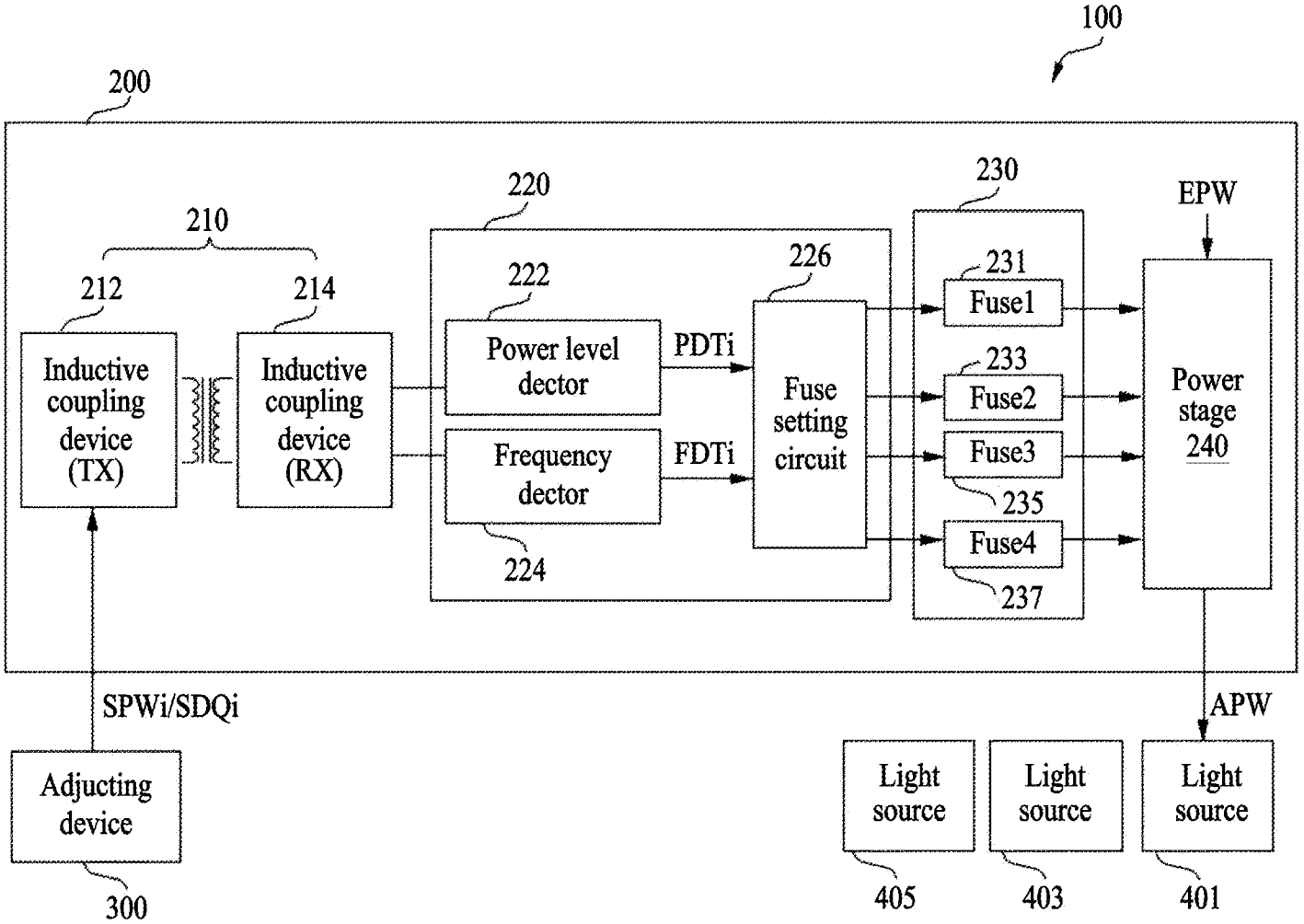
FIG. 1 is a block diagram illustrating a lighting device program system including a light source output control device programmable using an electronic fuse according to an example embodiment.

FIG. 1 is a block diagram of a lighting device program system including a light source output control device programmable using an electronic fuse according to an example embodiment.

Referring to FIG. 1, a lighting device program system 100 includes a light source output control device 200, an adjusting device 300, and a light source 401, 403, or 405.

The light source output control device 200 for controlling the output of the light source controls actuating power (APW) to be supplied to the light source 401, 403, or 405. Herein, power may be voltage or current.

The light source output control device 200 includes an inductive coupling device 210, a setting circuit 220, a fuse circuit 230, and a power stage (also referred to as a 'power supply circuit') 240.

The inductive coupling device (also referred to as an 'inductive coupler') 210 transfers power or frequency from an input circuit 212 to an output circuit 214 using inductive coupling. According to an example embodiment, the inductive coupling device 210 may be a transformer.

The inductive coupling device 210 includes the input circuit 212 and the output circuit 214. The input circuit 212 is also referred to as a primary circuit, a primary coil, or a primary winding, and the output circuit 214 is also referred to as a secondary circuit, a secondary coil, or a secondary winding.

Figure 2:
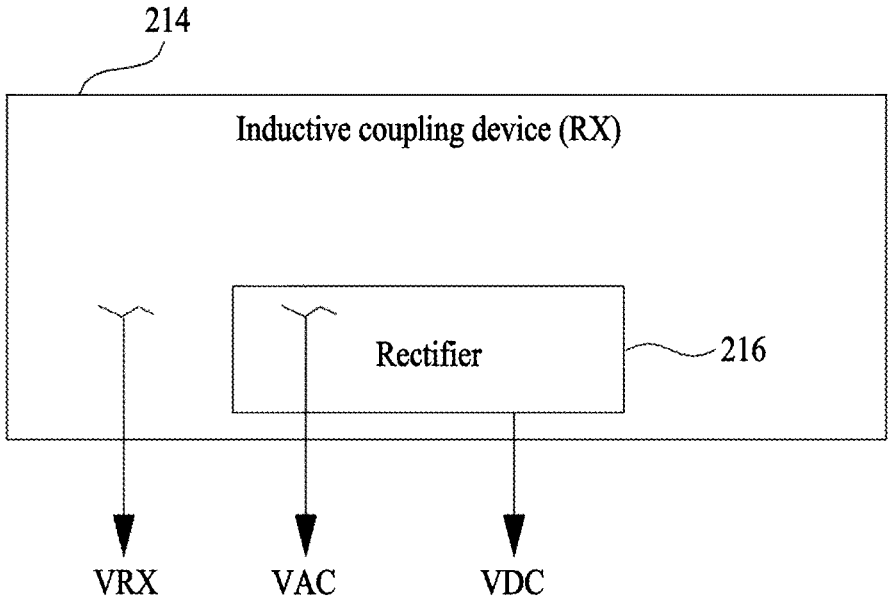
FIG. 2 is a block diagram illustrating an output circuit of an inductive coupling device illustrated in FIG. 1.

FIG. 2 is a block diagram of an output circuit of the inductive coupling device illustrated in FIG. 1. Referring to FIG. 2, a change in current of the input circuit 212 induces output power (VRX or VAC) of the output circuit 214 through electromagnetic induction.

According to example embodiments, the output circuit 214 may include a rectifier 216 which rectifies the output power (VRX) to generate a DC voltage (VDC). The DC voltage (VDC) may be used as an actuating voltage of the setting circuit 220 and/or the fuse circuit 230.

The output power (VRX) of the output circuit 214 or an intermediate power (VAC) of the rectifier 216 may be supplied to a power level detector 222 and a frequency detector 224. The intermediate power (VAC) refers to power having an AC component induced in the output circuit 214 before being rectified to the DC voltage (VDC).

The setting circuit 220 detects at least one of a level and a frequency of the output power (VRX or VAC) output from the output circuit 214 of the inductive coupling device 210, and adaptively sets (or programs) respective states of the fuses 231, 233, 235, and 237 included in the fuse circuit 230 using a result of the detection. An example of each of the fuses 231, 233, 235, and 237 may be an electronic fuse (eFuse). Although four fuses 231, 233, 235, and 237 are exemplarily illustrated in FIG. 1, the number of fuses may be variously changed according to example embodiments.

According to example embodiments, the setting circuit 220 includes at least one of the power level detector 222 and the frequency detector 224, and a fuse setting circuit 226.

The power level detector 222 detects the level of the output power (VRX or VAC) output from the output circuit 214 of the inductive coupling device 210, and generates a power level detection signal (PDTi, i is a natural number) according to a result of the detection.

Figure 3:
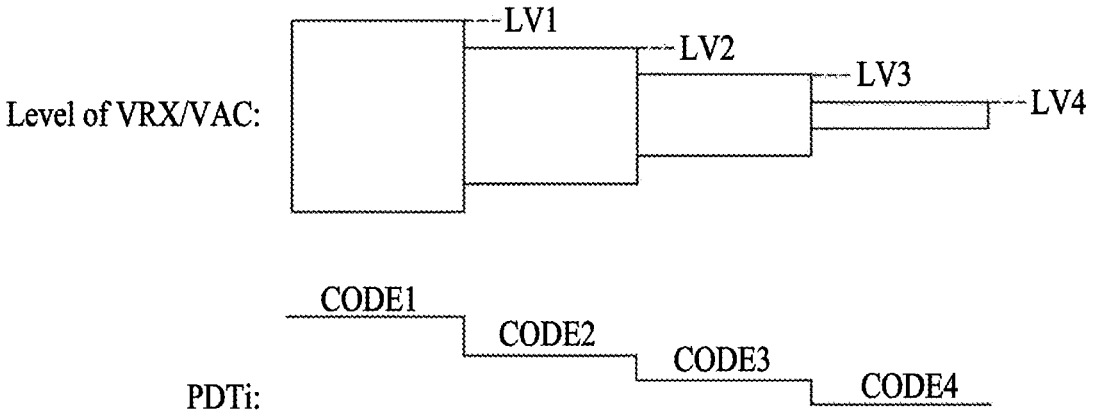
FIG. 3 is a diagram illustrating operation of a power level detector illustrated in FIG. 1.

FIG. 3 is a diagram illustrating operation of the power level detector illustrated in FIG. 1.

Referring to FIGS. 1 to 3, the adjusting device 300 supplies first input power (SPWi, i=1) to the input circuit 212 to induce output power (VRX or VAC) having a first level (LV1) by electromagnetic induction.

Here, the power level detector 222 detects the first level (LV1) of the output power (VRX or VAC), and generates a first power level detection signal (PDTi, i=1) according to a result of the detection. The first power level detection signal (PDT1) may be a first analog signal or a first digital signal (CODE1).

The adjusting device 300 supplies second input power (SPWi, i=2) to the input circuit 212 to induce output power (VRX or VAC) having a second level (LV2) by electromagnetic induction. Here, the power level detector 222 detects the second level (LV2) of the output power (VRX or VAC), and generates a second power level detection signal (PDTi, i=2) according to a result of the detection. The second power level detection signal (PDT2) may be a second analog signal or a second digital signal (CODE2).

The adjusting device 300 supplies third input power (SPWi, i=3) to the input circuit 212 to induce output power (VRX or VAC) having a third level (LV3) by electromagnetic induction. Here, the power level detector 222 detects the third level (LV3) of the output power (VRX or VAC), and generates a third power level detection signal (PDTi, i=3) according to a result of the detection. The third power level detection signal (PDT3) may be a third analog signal or a third digital signal (CODE3).

The adjusting device 300 supplies fourth input power (SPWi, i=4) to the input circuit 212 to induce output power (VRX or VAC) having a fourth level (LV4) by electromagnetic induction. Here, the power level detector 222 detects the fourth level (LV4) of the output power (VRX or VAC), and generates a fourth power level detection signal (PDTi, i=4) according to a result of the detection. The fourth power level detection signal (PDT4) may be a fourth analog signal or a fourth digital signal (CODE4).

Here, each input power (SPW1~SPW4) and each output power (VRX or VAC) are AC signals, the levels of the input power (SPW1~SPW4) are different from each other, the first level (LV1) is higher than the second level (LV2), the second level (LV2) is higher than the third level (LV3), and the third level (LV3) is higher than the fourth level (LV4). Each level (LV1, LV2, LV3, and LV4) may be a peak voltage or a peak current.

The frequency detector 224 detects the frequency of the output power (VRX or VAC) output from the output circuit 214 of the inductive coupling device 210, and generates a frequency detection signal (FDTi, i is a natural number) according to a result of the detection.

Figure 4:
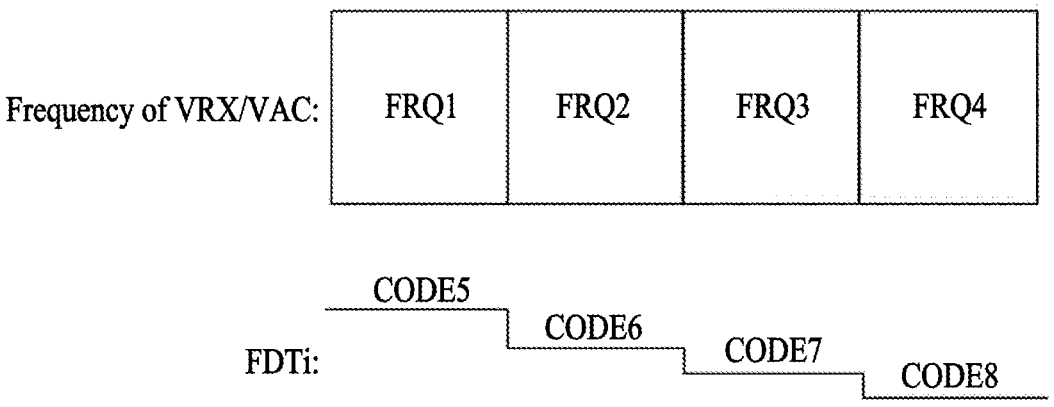
FIG. 4 is a diagram illustrating operation of a frequency detector illustrated in FIG. 1.

FIG. 4 is a diagram illustrating operation of the frequency detector illustrated in FIG. 1.

Referring to FIGS. 1, 2, and 4, the adjusting device 300 supplies first input power having a first input frequency (SFQi, i=1) to the input circuit 212 to induce output power (VRX or VAC) having a first output frequency (FRQ1) by electromagnetic induction.

Here, the frequency detector 224 detects the first output frequency (FRQ1) of the output power (VRX or VAC), and generates a first frequency detection signal (FDTi, i=1) according to a result of the detection. The first frequency detection signal (FDT1) may be a fifth analog signal or a fifth digital signal (CODE5).

The adjusting device 300 supplies second input power having a second input frequency (SFQi, i=2) to the input circuit 212 to induce output power (VRX or VAC) having a second output frequency (FRQ2) by electromagnetic induction.

Here, the frequency detector 224 detects the second output frequency (FRQ2) of the output power (VRX or VAC), and generates a second frequency detection signal (FDTi, i=2) according to a result of the detection. The second frequency detection signal (FDT2) may be a sixth analog signal or a sixth digital signal (CODE6).

The adjusting device 300 supplies third input power having a third input frequency (SFQi, i=3) to the input circuit 212 to induce output power (VRX or VAC) having a third output frequency (FRQ3) by electromagnetic induction.

Here, the frequency detector 224 detects the third output frequency (FRQ3) of the output power (VRX or VAC), and generates a third frequency detection signal (FDTi, i=3) according to a result of the detection. The third frequency detection signal (FDT3) may be a seventh analog signal or a seventh digital signal (CODE7).

The adjusting device 300 supplies fourth input power having a fourth input frequency (SFQi, i=4) to the input circuit 212 to induce output power (VRX or VAC) having a fourth output frequency (FRQ4) by electromagnetic induction.

Here, the frequency detector 224 detects the fourth output frequency (FRQ4) of the output power (VRX or VAC), and generates a fourth frequency detection signal (FDTi, i=4) according to a result of the detection. The fourth frequency detection signal (FDT4) may be an eighth analog signal or an eighth digital signal (CODE8). Levels of the first input power to fourth input power may be the same or different from each other.

Here, the first output frequency (FRQ1, for example, 15 MHz) is higher than the second output frequency (FRQ2, for example, 12 MHz), the second output frequency (FRQ2) is higher than the third output frequency (FRQ3, for example, 10 MHz), and the third output frequency (FRQ3) is higher than the fourth output frequency (FRQ4, for example, 8 MHz).

The fuse setting circuit 226 sets (also refer to as 'programs') a state of each of the electronic fuses 231, 233, 235, and 237 using at least one of the power level detection signal (PDTi) and the frequency detection signal (FDTi).

According to an example embodiment, it is assumed that an initial state of each of the electronic fuses 231, 233, 235, and 237 is a short, and the fuse setting circuit 226 receives only the power level detection signal (PDTi).

When the first power level detection signal (PDT1) is detected by the fuse setting circuit 226, the fuse setting circuit 226 sets the state of the first electronic fuse 231 to open.

When the second power level detection signal (PDT2) is detected by the fuse setting circuit 226, the fuse setting circuit 226 sets the state of the second electronic fuse 233 to open.

When the third power level detection signal (PDT3) is detected by the fuse setting circuit 226, the fuse setting circuit 226 sets the state of the third electronic fuse 235 to open.

When the fourth power level detection signal (PDT4) is detected by the fuse setting circuit 226, the fuse setting circuit 226 sets or programs the state of the fourth electronic fuse 237 to open.

According to another example embodiment, it is assumed that the initial state of each of the electronic fuses 231, 233, 235, and 237 is a short, and the fuse setting circuit 226 receives only the frequency detection signal (FDTi).

When the first frequency detection signal (FDT1) is detected by the fuse setting circuit 226, the fuse setting circuit 226 sets the state of the first electronic fuse 231 to open.

When the second frequency detection signal (FDT2) is detected by the fuse setting circuit 226, the fuse setting circuit 226 sets the state of the second electronic fuse 233 to open.

When the third frequency detection signal (FDT3) is detected by the fuse setting circuit 226, the fuse setting circuit 226 sets the state of the third electronic fuse 235 to open.

When the fourth frequency detection signal (FDT4) is detected by the fuse setting circuit 226, the fuse setting circuit 226 sets the state of the fourth electronic fuse 237 to open.

Figure 5:
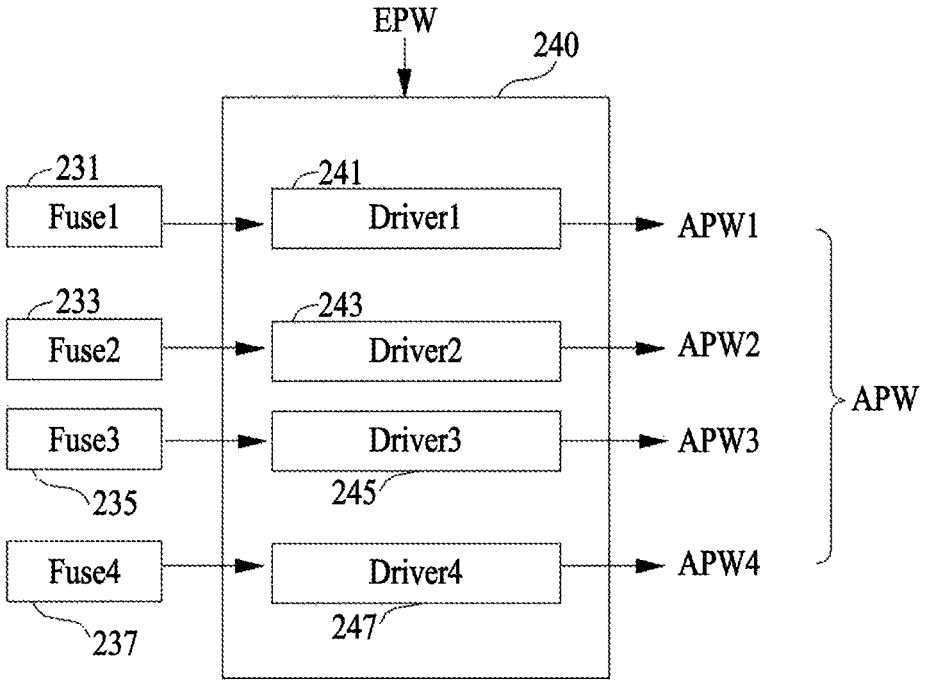
FIG. 5 is a block diagram illustrating an example embodiment of a power stage illustrated in FIG. 1.

FIG. 5 is a block diagram of an example embodiment of the power stage illustrated in FIG. 1.

The power stage 240 generates the actuating power (APW) to be supplied to the light source 401, 403, or 405, using output signals generated according to external power (EPW) and the states of the electronic fuses 231, 233, 235, and 237.

The power stage 240 includes drivers 241, 243, 245, and 247.

Figure 8:
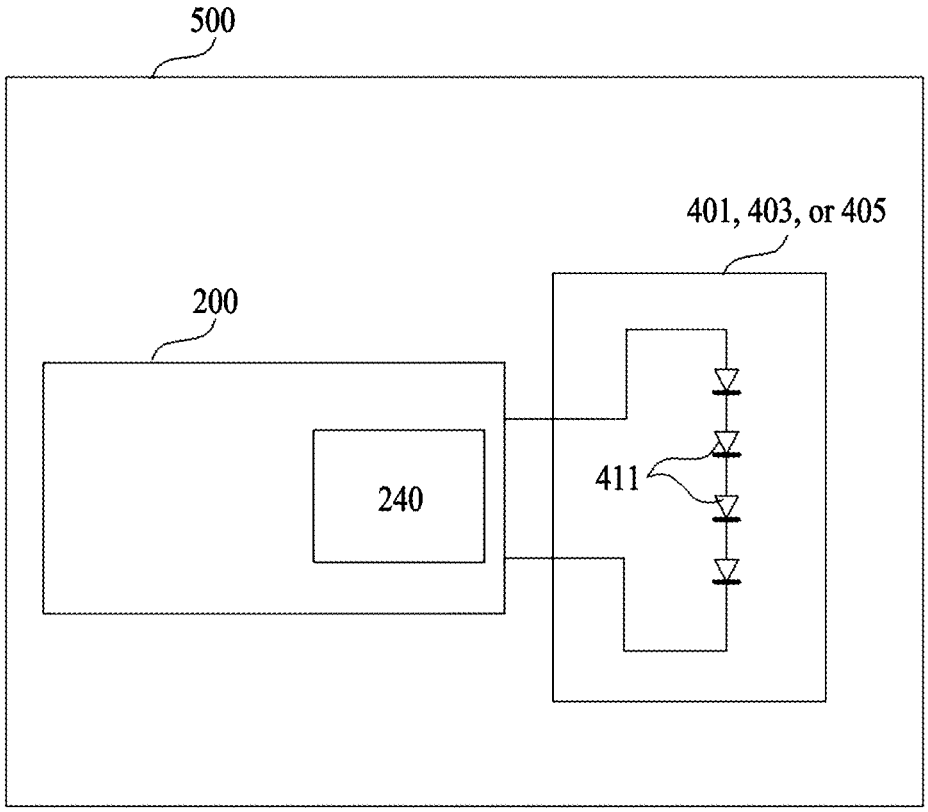
FIG. 8 is a block diagram illustrating a lighting device including the light source output control device and a light source illustrated in FIG. 1.

The light source 401, 403, or 405 driven by the light source output control device 200 includes LEDs 411 as illustrated in FIG. 8.

According to example embodiments, each of the drivers 241, 243, 245, and 247 performs a function of a controllable current source which supplies the actuating power (APW, i.e., a drive current) for driving the LEDs 411 of the light source 401, 403, or 405.

According to example embodiments, each of the drivers 241, 243, 245, and 247 includes a rectifier which rectifies the external power (EPW, e.g., an AC voltage) to produce the actuating power (APW, i.e, the drive current) for driving the LEDs 411 of the light source 401, 403, or 405.

When only the state of the first electronic fuse 231 is set to open, the first driver 241 enabled according to an output signal (or an output signal determined according to the open state) of the first electronic fuse 231 supplies a first current corresponding to first actuating power (APW1) to the LEDs 411 of the light source 401, 403, or 405. Here, the corresponding drivers 243, 245, and 247 are disabled according to output signals (or output signals determined according to the short state) of the corresponding electronic fuses 233, 235, and 237.

When only the state of the second electronic fuse 233 is set to open, the second driver 243 enabled according to the output signal of the second electronic fuse 233 supplies a second current corresponding to a second actuating power (APW2) to the LEDs 411 of the light source 401, 403, or 405. Here, the corresponding drivers 241, 245, and 247 are disabled according to the output signals of the corresponding electronic fuses 231, 235, and 237.

When only the state of the third electronic fuse 235 is set to open, the third driver 245 enabled according to the output signal of the third electronic fuse 235 supplies a third current corresponding to a third actuating power (APW3) to the LEDs 411 of the light source 401, 403, or 405. Here, the corresponding drivers 241, 243, and 247 are disabled according to the output signals of the corresponding electronic fuses 231, 233, and 237.

When only the state of the fourth electronic fuse 237 is set to open, the fourth driver 247 enabled according to the output signal of the fourth electronic fuse 237 supplies a third current corresponding to a fourth actuating power (APW4) to the LEDs 411 of the light source 401, 403, or 405. Here, the corresponding drivers 241, 243, and 245 are disabled according to the output signals of the corresponding electronic fuses 231, 233, and 235.

The amount or level of each of the first actuating power (APW1) to fourth actuating power (APW4) is different from each other.

Figure 6:
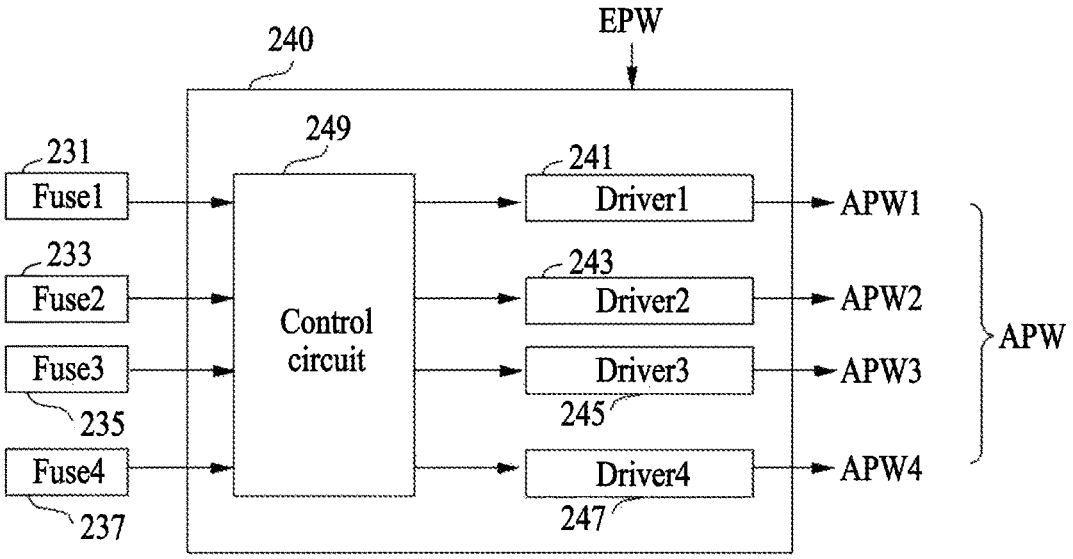
FIG. 6 is a block diagram illustrating another example embodiment of the power stage illustrated in FIG. 1.

FIG. 6 is a block diagram of another example embodiment of the power stage illustrated in FIG. 1.

Referring to FIG. 6, the power stage 240 includes a control circuit 249 which controls an operation of each of the drivers 241 to 247. The control circuit 249 may control the operation of each of the drivers 241, 243, 245, and 247 by combining output signals determined according to the states (e.g., short or open) of the electronic fuses 231, 233, 235, and 237.

Referring to FIGS. 1, 5, and 6, when the state of the first electronic fuse 231 is different from the respective states of the electronic fuses 233, 235, and 237, the power stage 240 supplies a first current corresponding to the first actuating power (APW1) to the LEDs 411 of the light source 401, 403, or 405. Further, when the state of the fourth electronic fuse 237 is different from the respective states of the electronic fuses 231, 233, and 235, the power stage 240 supplies a fourth current corresponding to the fourth actuating power (APW4) to the LEDs 411 of the light source 401, 403, or 405.

Each of the drivers 241, 243, 245, and 247 is a device which controls illuminance of the light source 401, 403, or 405 by changing a voltage or current.

A driving method of each of the drivers 241, 243, 245, and 247 is classified into a constant voltage driving method, a constant current driving method, and a PWM driving method.

The constant voltage driving method is a method of securing a desired forward current by maintaining a constant voltage applied to the LEDs 411, the constant current driving method is a method of controlling the illuminance by maintaining a forward current of the LEDs 411 using a constant current circuit, and the PWM driving method is a method of controlling the brightness of lighting by repeatedly turning on/off the current of the LEDs 411 for a short time.

Figure 7:
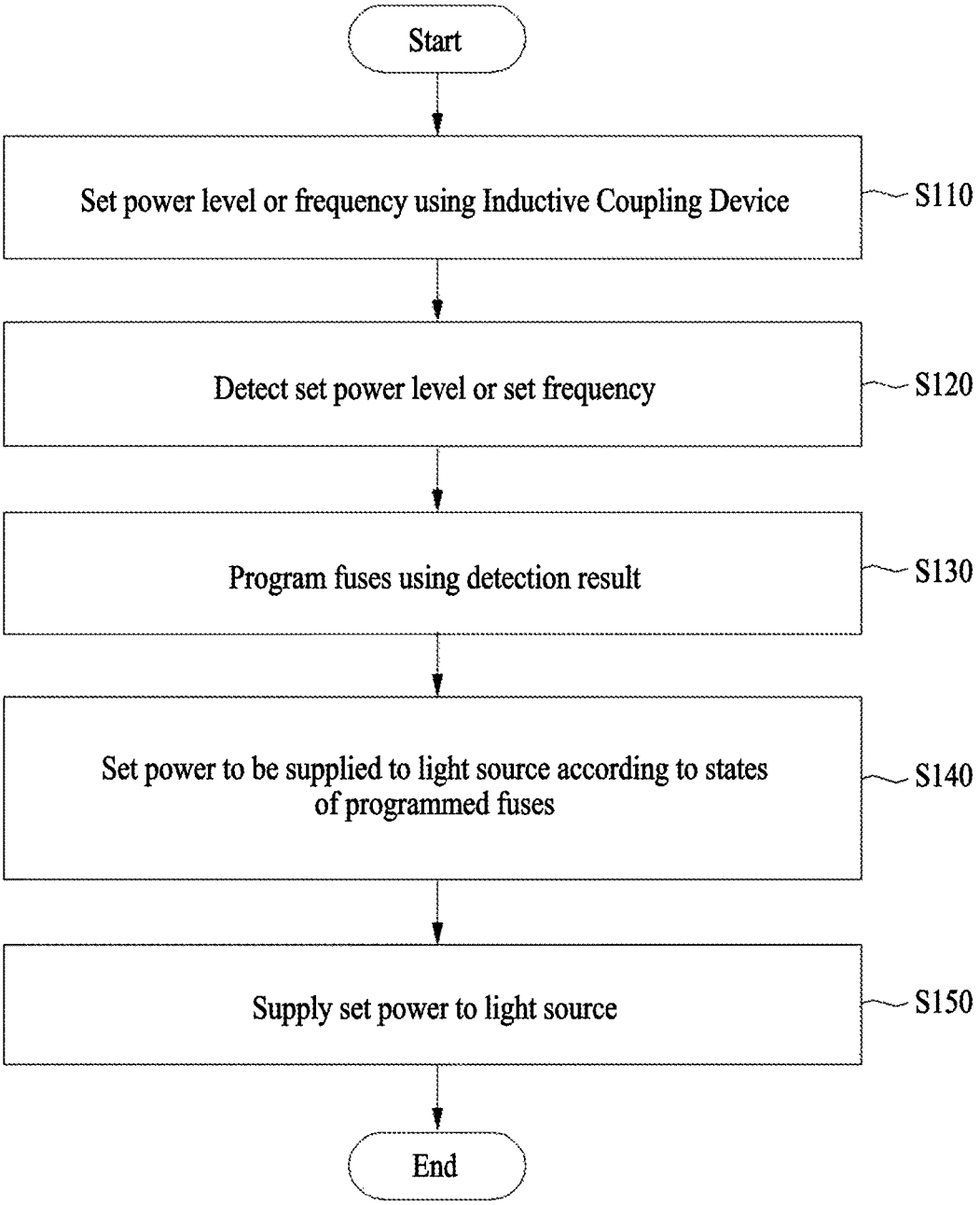
FIG. 7 is a flowchart illustrating operation of the lighting device program system illustrated in FIG. 1.

FIG. 7 is a flowchart illustrating operation of the lighting device program system illustrated in FIG. 1, and FIG. 8 is a block diagram of a lighting device including the light source output control device and the light source illustrated in FIG. 1. Examples of a lighting device 500 include a home lighting device, an industrial lighting device, a lighting device for automobiles, and a lighting device for home appliances.

1. Adjust the Level of Each Input Power

According to example embodiments, a process in which an operator sequentially programs information on each actuating power (APW1, APW3, and APW4) to be supplied to each of the light sources 401, 403, and 405 by adjusting the level of each input power (SPW1, SPW3, and SPW4) using the adjusting device 300 is exemplarily described with reference to FIGS. 1 to 8.

When the operator supplies the input circuit 212 of the inductive coupling device 210 with the first input power (SPW1) using the adjusting device 300, the output circuit 214 of the inductive coupling device 210 generates output power (VRX or VAC) having a first level (LV1) using the first input power (SPW1) (S110).

The power level detector 222 detects the first level (LV1) of the output power (VRX or VAC), and generates a first power level detection signal (PDT1) according to the detection result (S120).

The fuse setting circuit 226 sets the state of the first electronic fuse 231 to open (or cut) using the first power level detection signal (PDT1), and maintains the respective states of the remaining electronic fuses 233, 235, and 237 to short (or uncut) (S130).

The power stage 240 generates a first actuating power (APW1) to be supplied to the light source 401, by using the output signals determined according to the external power (EPW) and the states of the electronic fuses 231, 233, 235, and 237 (S140).

After the first actuating power (APW1) is set to be supplied to the light source 401 by the light source output control device 200, the power stage 240 supplies the first actuating power (APW1) to the LEDs 411 of the light source 401 (S150).

Subsequently, when the operator supplies the input circuit 212 of the inductive coupling device 210 with the third input power (SPW3) using the adjusting device 300, the output circuit 214 of the inductive coupling device 210 generates the output power (VRX or VAC) having the third level (LV3) by using the third input power (SPW3) (S110).

The power level detector 222 detects the third level LV3 of the output power (VRX or VAC), and generates a third power level detection signal PDT3 according to the detection result (S120).

The fuse setting circuit 226 sets the state of the third electronic fuse 235 to open using the third power level detection signal (PDT3), and maintains the respective states of the remaining electronic fuses 233, 235, and 237 to short (S130).

The power stage 240 generates a third actuating power (APW3) to be supplied to the light source 401, by using the output signals determined according to the external power (EPW) and the states of the electronic fuses 231, 233, 235, and 237 (S140).

After the third actuating power (APW3) is set to be supplied to the light source 401 by the light source output control device 200, the power stage 240 supplies the third actuating power (APW3) to the LEDs 411 of the light source 403 (S150).

Subsequently, when the operator supplies the input circuit 212 of the inductive coupling device 210 with the fourth input power (SPW4) using the adjusting device 300, the output circuit 214 of the inductive coupling device 210 generates the output power (VRX or VAC) having the fourth level (LV4) by using the fourth input power (SPW4) (S110).

The power level detector 222 detects the fourth level (LV4) of the output power (VRX or VAC) and generates a fourth power level detection signal (PDT4) according to the detection result (S120).

The fuse setting circuit 226 sets the state of the fourth electronic fuse 237 to open using the fourth power level detection signal (PDT4), and maintains the respective states of the remaining electronic fuses 231, 233, and 235 to short (S130).

The power stage 240 generates a fourth actuating power (APW4) to be supplied to the light source 405, by using the output signals corresponding to the external power (EPW) and the states of the electronic fuses 231, 233, 235, and 237 (S140).

After the fourth actuating power (APW4) is set to be supplied to the light source 401 by the light source output control device 200, the power stage 240 supplies the fourth actuating power (APW4) to the LEDs 411 of the light source 405 (S150).

2. Adjust the Frequency of Each Input Power

According to another example embodiment, a process in which the operator sequentially programs each actuating power (APW1, APW3, and APW4) to be supplied to each of the light sources 401, 403, and 405 by adjusting the frequency of each input power (SPW1, SPW3, and SPW4) using the adjusting device 300 is exemplarily described with reference to FIGS. 1 to 8. When adjusting the frequency, the level of each input power (SPW1, SPW3, and SPW4) is assumed to be the same. However, according to an example embodiment, when the frequency is adjusted, the level of each input power (SPW1, SPW3, and SPW4) may be different from each other.

When the operator supplies the input circuit 212 with the first input power having the first input frequency (SFQi, i=1) using the adjusting device 300 to induce the output power (VRX or VAC) having the first output frequency (FRQ1) by the electromagnetic induction, the frequency detector 224 detects the first output frequency (FRQ1) of the output power (VRX or VAC) and generates the first frequency detection signal (FDT1) according to the detection result (S120).

The fuse setting circuit 226 sets the state of the first electronic fuse 231 to open by using the first frequency detection signal (FDT1), and maintains the respective states of the remaining electronic fuses 233, 235, and 237 to short (S130).

The power stage 240 generates the first actuating power (APW1) to be supplied to the light source 401, by using the output signals corresponding to the external power (EPW) and the states of the electronic fuses 231, 233, 235, and 237 (S140).

After the first actuating power (APW1) is set to be supplied to the light source 401 by the light source output control device 200, the power stage 240 supplies the first actuating power (APW1) to the LEDs 411 of the light source 401 (S150).

*97 Subsequently, when the operator supplies the input circuit 212 with the first input power having the third input frequency (SFQ3) using the adjusting device 300 to induce output power (VRX or VAC) having the third output frequency (FRQ3) by electromagnetic induction, the frequency detector 224 detects the third output frequency (FRQ3) of the output power (VRX or VAC) and generates the third frequency detection signal (FDT3) according to the detection result (S120).

The fuse setting circuit 226 sets the state of the third electronic fuse 235 to open by using the third frequency detection signal (FDT3), and maintains the respective states of the remaining electronic fuses 231, 233, and 237 to short (S130).

The power stage 240 generates the third actuating power (APW3) to be supplied to the light source 403, by using the output signals corresponding to the external power (EPW) and the states of the electronic fuses 231, 233, 235, and 237 (S140).

After the third actuating power (APW3) is set to be supplied to the light source 403 by the light source output control device 200, the power stage 240 supplies the third actuating power (APW3) to the LEDs 411 of the light source 403 (S150).

*101 Subsequently, when the operator supplies the input circuit 212 with the first input power having the fourth input frequency (SFQ4) using the adjusting device 300 to induce the output power (VRX or VAC) having the fourth output frequency (FRQ4) by electromagnetic induction, the frequency detector 224 detects the fourth output frequency (FRQ4) of the output power (VRX or VAC) and generates the fourth frequency detection signal (FDT4) according to the detection result (S120).

The fuse setting circuit 226 sets the state of the fourth electronic fuse 237 to open by using the fourth frequency detection signal (FDT4), and maintains the respective states of the remaining electronic fuses 231, 233, and 235 to short (S130).

The power stage 240 generates the fourth actuating power (APW4) to be supplied to the light source 405, by using the output signals corresponding to the external power (EPW) and the states of the electronic fuses 231, 233, 235, and 237 (S140).

After the fourth actuating power (APW4) is set to be supplied to the light source 401 by the light source output control device 200, the power stage 240 supplies the fourth actuating power (APW4) to the LEDs 411 of the light source 405 (S150).

The light source 401, 403, or 405 may be driven using the corresponding actuating power APW1, APW2, APW3, or APW4 depending on how each of the electronic fuses 231, 233, 235, and 237 is programmed.

According to example embodiments, the light source output control device 200 may include the fuse circuit 230 and the power stage (also referred to as the 'power supply circuit') 240. The fuse circuit 230 may include the fuses 231, 233, 235, and 237 having a structure cut by laser irradiation. Accordingly, the lighting device program system 100 may include the light source output control device 200, the light source 401, 403, or 405, and a laser generating device for generating a laser.

The power stage 240 generates the actuating power (APW, for example, drive current) to be supplied to each light source 401, 403, or 405 using the external power (EPW, for example, AC voltage, for example, 110V or 220V, etc.) supplied from the outside and the output signals generated according to the states (for example, cut state or uncut state) of the fuses 231, 233, 235, and 237 having the structure cut by the laser irradiation.

The example embodiments disclosed in the present specification and the drawings are intended merely to present specific examples in order to aid in understanding of the present disclosure, but are not intended to limit the scope of the present disclosure. It will be apparent to those skilled in the art that various modifications based on the technical spirit of the present disclosure, as well as the disclosed example embodiments, can be made. Therefore, the scope of the disclosure is defined not by the detailed description, but by the claims and their equivalents, and all variations within the scope of the claims and their equivalents are to be construed as being included in the disclosure.

What is claimed is:

1. A programmable light source output control device comprising:

electronic fuses;

a power stage configured to receive external power, generate actuating power according to the external power and a state of each of the electronic fuses, and supply the actuating power to a light source;

an inductive coupling device configured to transmit power using inductive coupling; and a setting circuit configured to set the state of each of the electronic fuses, wherein the setting circuit comprises:

a power level detector configured to detect a level of output power of the inductive coupling device and output a power level detection signal according to a result of the detection; and a fuse setting circuit configured to set the state of each of the electronic fuses by using the power level detection signal.

2. The light source output control device of claim 1, wherein the inductive coupling device configured to transmit a frequency using inductive coupling, wherein the setting circuit comprises:

a frequency detector configured to detect a frequency of output power of the inductive coupling device and output a frequency detection signal according to a result of the detection, wherein the fuse setting circuit configured to set the state of each of the electronic fuses by using at least one of the power level detection signal and the frequency detection signal.

3. The light source output control device of claim 1, wherein the light source comprises light emitting diodes (LEDs).

4. The light source output control device of claim 3, wherein the power stage comprises a controllable current source configured to supply a current for driving the LEDs, and the current is the actuating power.

5. The light source output control device of claim 3, wherein the external power is an AC voltage, the power stage comprises a rectifier configured to rectify the AC voltage to generate a current for driving the LEDs, and the current is the actuating power.

6. The light source output control device of claim 3, wherein the power stage comprises:

a control circuit configured to generate control signals by combining output signals of the electronic fuses; and drivers, each of the drivers configured to be enabled or disabled in response to each of the control signals, and an enabled driver among the drivers is configured to supply a current for driving the LEDs.

7. A lighting device comprising:

a light source;

electronic fuses;

a power stage configured to receive external power, generate actuating power according to the external power and a state of each of the electronic fuses, and supply the actuating power to the light source;

an inductive coupling device configured to transmit power using inductive coupling; and a setting circuit configured to set the state of each of the electronic fuses, wherein the setting circuit comprises:

a power level detector configured to detect a level of output power of the inductive coupling device and output a power level detection signal according to a result of the detection; and a fuse setting circuit configured to set the state of each of the electronic fuses by using the power level detection signal.

8. The lighting device of claim 7, wherein the inductive coupling device configured to transmit a frequency using inductive coupling, wherein the setting circuit comprises:

a frequency detector configured to detect a frequency of output power of the inductive coupling device and output a frequency detection signal according to a result of the detection; and wherein the fuse setting circuit configured to set the state of each of the electronic fuses by using at least one of the power level detection signal and the frequency detection signal.

9. The lighting device of claim 7, wherein the light source comprises light emitting diodes (LEDs), the power stage comprises a controllable current source configured to supply a current for driving the LEDs, and the current is the actuating power.

10. The lighting device of claim 7, wherein the light source comprises LEDs, the external power is an AC voltage, the power stage comprises a rectifier configured to rectify the AC voltage to generate a current for driving the LEDs, and the current is the actuating power.

11. A method of programming a lighting device comprising a light source, the method comprising:

setting, by using an inductive coupling device, at least one of a level and a frequency of output power of the inductive coupling device;

detecting at least one of the level and the frequency using a setting circuit;

programming electronic fuses using a result of the detection using the setting circuit; and generating power to be supplied to the light source according to states of the electronic fuses programmed using a power stage.

12. The method of claim 11, further comprising:

supplying set power to the light source, using the power stage.

* * * * *